United States Patent [19]

Gassman

[11] 3,987,628

[45] Oct. 26, 1976

[54] CHARGE PUMP AUGMENTING DEVICE

[75] Inventor: Max Paul Gassman, Waterloo, Iowa

[73] Assignee: Deere & Company, Moline, Ill.

[22] Filed: Mar. 4, 1976

[21] Appl. No.: 663,965

[52] U.S. Cl. ..... 60/464; 60/486; 60/DIG. 5; 417/76; 417/87

[51] Int. Cl.[2] ..... F16D 31/00; F15B 13/09

[58] Field of Search ..... 60/329, 378, 456, 464, 60/486, DIG. 5; 417/4, 76, 81, 87

[56] References Cited

UNITED STATES PATENTS

| | | | |
|---|---|---|---|
| 2,961,829 | 11/1960 | Weisenbach | 60/464 |
| 3,043,107 | 7/1962 | Magnus | 417/87 X |
| 3,309,995 | 3/1967 | Tyler | 417/203 |
| 3,370,423 | 2/1968 | Vaughan | 60/464 |

*Primary Examiner*—Edgar W. Geoghegan

[57] ABSTRACT

A charge pump augmenting device includes a jet pump, powered by fluid flow from a main pump, to draw fluid through a check valve from a reservoir to supply additional fluid to the main pump when the charge pump supplying the main pump is inadequate to meet the demands of the main pump.

3 Claims, 1 Drawing Figure

CHARGE PUMP AUGMENTING DEVICE

BACKGROUND OF THE INVENTION

The invention relates generally to hydraulic systems utilizing charge pumps and more particularly to an improved hydraulic system having a jet pump to augment the charge pump.

In the past, in hydraulic systems having a main pump and a charge pump, the charge pump was always sized so as to be large enough to supply the demands of the main pump under all conditions. Even with proper sizing of the charge and main pumps for all normal conditions, it has been found that at new elevated operating temperatures and low charge pump speeds that a properly sized charge pump is inadequate to keep up with the leakage through the system and a costly, larger charge pump is required to provide adequate fluid to the main pump to prevent destructive cavitation therein.

SUMMARY OF THE INVENTION

The present invention provides a charge pump augmenting device which eliminates the necessity of having a larger charge pump than necessary to meet the normal requirements of the main pump.

In accordance with the present invention there is provided, a venturi-containing jet pump powered by fluid flow from the main pump adding fluid to the inlet of the main pump. The fluid flow is controlled by a control valve connected to the outlet of the jet pump to maintain a predetermined pressure thereat and a reservoir connected check valve allows fluid from the reservoir to be drawn into the jet pump.

The above and additional advantages of the present invention will become apparent to those skilled in the art from a consideration of the following detailed description of the preferred embodiment when taken in conjunction with the accompanying drawing.

BRIEF DESCRIPTION OF THE DRAWING

The drawing shows schematically and partially in section the hydraulic system incorporating the present invention.

DESCRIPTION OF THE PREFERRED EMBODIMENT

Figure 1:
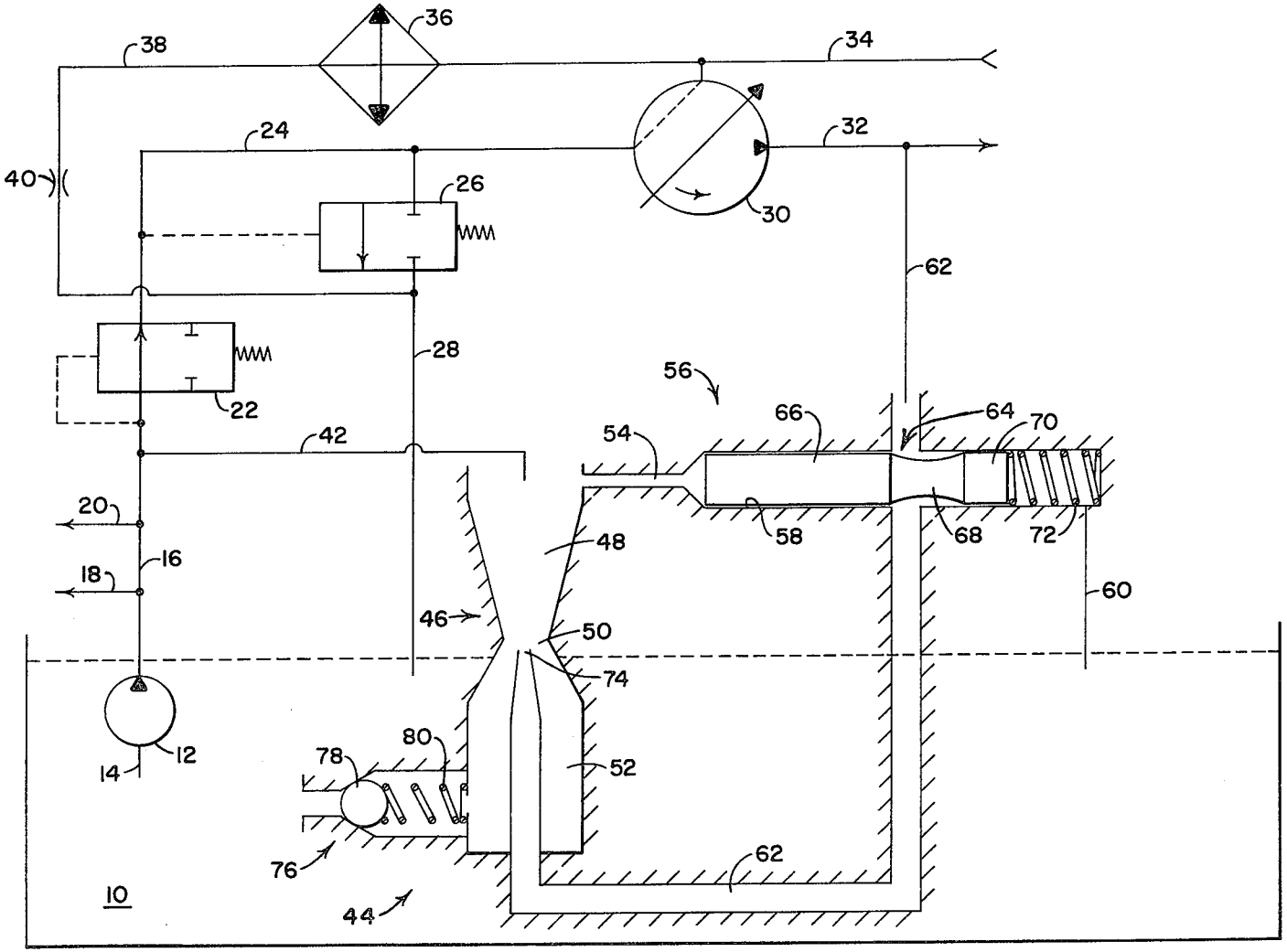

Referring now to the drawing, therein is shown a reservoir 10 having immersed therein a charge pump 12 having an inlet line 14 and an outlet charge line 16.

The outlet charge line 16 is connected to a transmission line 18 for a vehicle transmission (not shown) and a clutch line 20 for a clutch control and lubricating system (not shown). The outlet charge line 16 is further connected to a conventional pressure control valve 22 which normally blocks the flow of fluid therethrough from the outlet charge line 16 to a main pump inlet line 24. The main pump inlet line 24 is connected by a conventional overload relief valve 26 which normally blocks the flow of fluid therethrough, to a reservoir connected reservoir line 28.

The main pump inlet line 24 is further connected to the inlet of a main pump 30. The main pump 30 has an outlet connected to a motor supply line 32 for various fluid motors (not shown). The exhaust of fluid from the fluid motor is through a motor return line 34 which is connected to a filter 36 and thence to a motor return line 38 which has therein a restrictor 40 and thence to the reservoir line 28.

To augment the fluid in the outlet charge line 16, there is provided an augmenting line 42 connected thereto at one end and connected at the other end to a jet pump generally designated by the numeral 44. The jet pump 44 consists of a venturi 46 which is made up of a venturi nozzle 48, a venturi throat 50, and a venturi chamber 52. The venturi nozzle 48 is connected by a pilot line 54 to a control valve 56. The control valve 56 has provided therein a bore 58 which connects to the pilot line 54 at one end and to a relief line 60 at the other end. A jet pump inlet line 62 intersects the bore 58 between the pilot line 54 and the relief line 60. A piston 64 is positioned in the bore having a head portion 66 proximate the pilot line 54. The head portion 66 is connected by a throat portion 68 to a tail portion 70 of the piston 64. The tail portion 70 abuts a spring 72 and compresses it against the relief line 60 connected end of the bore 58.

The jet pump inlet line 62 is connected to the motor supply line 32 at one end and terminates in a nozzle 74 at the other end. The nozzle 74 is positioned in the venturi throat 50.

A check valve 76 is immersed in the reservoir 10 and includes a ball 78 and a spring 80. The check valve 76 is connected to the venturi chamber 52 and prevents the flow of fluid from the venturi chamber 52 into the reservoir 10.

In normal operation, the charge pump 12 draws fluid from the reservoir 10 and supplies the outlet charge line 16 with fluid pressurized to an intermediate level. A portion of the charge pump 12 output is used for the transmission and clutch while the remainder opens the pressure control valve 22 so as to permit the flow at the intermediate pressure level to the main pump 30 and thence at a high pressure to the fluid motors.

The pressurization of the outlet charge line 16 causes pressurization of the venturi nozzle 48. The pressure acting on the control valve 56 which is connected to the venturi nozzle 48 will cause the piston 64 to act against and compress the spring 72. With compression of the spring 72, the piston throat portion 68 will be moved out of the position permitting flow from the main pump 30 to the nozzle 74. With the piston head portion 66 blocking the jet pump inlet line 62, there will be no flow out of the nozzle 74 and thus the pressure in the venturi throat 50 and the venturi chamber 52 will be at the intermediate pressure level preventing the opening of the check valve 76.

During operation, and as the temperature increases while the charge pump 12 speed decreases, the pressure in the outlet charge line 16 will decrease due to increased leakage. As the pressure in the outlet charge line 16 decreases, the pressure in the venturi nozzle 48 decreases to a predetermined level allowing the control valve 56 to permit the flow of fluid from the main pump 30 to the nozzle 74. The flow out of the nozzle 74 and into the venturi throat 50 will cause the well-known venturi effect which will reduce the pressure in the venturi chamber 52. A reduction of the pressure in the venturi chamber 52 below the holding force of the spring 80 will cause the check valve 78 to open and allow fluid to be drawn from the reservoir 12 into the venturi chamber 52. The fresh fluid is added to the fluid from the main pump in the venturi throat 50 and is supplied through the augmenting line 42 to the outlet charge line 16. When the pressure in the venturi nozzle 48 again reaches the predetermined level, the control valve 56 will be moved to block the jet pump inlet line 62 and stop the drawing of fluid through the check valve 76. Therefore, there is provided a charge pump augmenting device for automatically augmenting the flow of fluid in the charge line 16 when the charge pump 12 is of inadequate capacity at low speeds and high temperatures to supply the main pump 30.

While the invention has been described in conjunction with a specific embodiment, it is to be understood that many alternatives, modifications, and variations will be apparent to those skilled in the art in light of the foregoing description. Accordingly, it is intended to embrace all such alternatives, modifications, and variations which fall within the spirit and scope of the appended claims.

I claim:

1. In a hydraulic system having a main pump, a fluid reservoir, and a charge pump for supplying fluid from the reservoir to the main pump, a charge pump augmenting device comprising: augmenting means connected to passage means between the charge and main pumps, to the main pump, and to the reservoir responsive to a fluid pressure between the charge and main pumps below a predetermined pressure level and to the operation of the main pump to draw fluid from the reservoir and add the fluid to the passage means between the charge and main pumps.

2. In a hydraulic system having a fluid reservoir, a main pump having an inlet fluidly connected to the reservoir and an outlet fluidly connected to a fluid motor, and a charge pump disposed in the connection between the reservoir and the main pump for supplying pressurized fluid to the main pump from the reservoir, a charge pump augmenting device comprising: jet pump means having an inlet connected to between the main pump and the fluid motor and having an outlet connected to passage means between the charge and main pumps; valve means disposed between the outlet of the main pump and the inlet of the venturi means normally allowing the flow of fluid therethrough and connected to the outlet of the venturi means responsive to a predetermined pressure at the outlet of the venturi means to block the flow of fluid from the main pump to the venturi means; and check valve means connected to the reservoir and to the venturi means responsive to the flow of fluid from the pump to the venturi means to allow the passage of fluid from the reservoir to the venturi means.

3. In a hydraulic system having a fluid reservoir, a charge pump, inlet passage means connecting the fluid reservoir to the charge pump, a main pump, charge pump fluid passage means connecting the charge pump to the main pump, a fluid motor, and motor fluid passage means connecting the main pump to the fluid motor, a charge pump augmenting device comprising: jet pump means having a venturi chamber, a venturi throat, and a venturi nozzle provided therein; augmenting passage means connecting the venturi nozzle to the charge pump fluid passage means; jet pump inlet means connected to the motor fluid passage means and having an output nozzle positioned in the venturi throat; pilot valve means disposed in the jet pump inlet means having a pilot line connected to the venturi nozzle biased to allow the flow of fluid through the jet pump inlet means responsive to a predetermined fluid pressure in the pilot line to block the flow of fluid from the main pump to the nozzle of the jet pump inlet means; and check valve means fluidly connected to the reservoir and to the venturi chamber normally preventing the flow of fluid from the reservoir to the venturi chamber responsive to the pressure drop due to the flow of fluid from the nozzle of the jet pump inlet means through the venturi throat to allow the flow of fluid from the reservoir to the venturi chamber.

* * * * *